US012297617B2

(12) United States Patent
Messelis

(10) Patent No.: US 12,297,617 B2
(45) Date of Patent: May 13, 2025

(54) ANCHORING DEVICE

(71) Applicant: GUARDIAR EUROPE BVBA, Zwevegem (BE)

(72) Inventor: Timothy Messelis, Lauwe (BE)

(73) Assignee: GUARDIAR EUROPE BVBA, Zwevegem (BE)

( * ) Notice: Subject to any disclaimer, the term of this patent is extended or adjusted under 35 U.S.C. 154(b) by 528 days.

(21) Appl. No.: 17/309,018

(22) PCT Filed: Oct. 23, 2018

(86) PCT No.: PCT/IB2018/058242
§ 371 (c)(1),
(2) Date: Apr. 14, 2021

(87) PCT Pub. No.: WO2020/084330
PCT Pub. Date: Apr. 30, 2020

(65) Prior Publication Data

US 2021/0348359 A1 Nov. 11, 2021

(51) Int. Cl.
*E02D 27/42* (2006.01)
*E01F 13/12* (2006.01)
(Continued)

(52) U.S. Cl.
CPC ..... *E02D 27/42* (2013.01); *E01F 13/12* (2013.01); *E01F 15/06* (2013.01); *E04H 17/009* (2021.01); *E04H 17/20* (2013.01)

(58) Field of Classification Search
CPC ..... E02D 27/42; E01F 15/02; E01F 15/06; E04H 17/009; E04H 17/08; E04H 17/20; E04H 17/22; E04H 12/22; E04H 12/2292
See application file for complete search history.

(56) References Cited

U.S. PATENT DOCUMENTS 274,118 A * 3/1883 Gholson ..... E04H 17/08 256/48
513,200 A * 1/1894 Reist ..... E04H 17/08 52/151

(Continued)

FOREIGN PATENT DOCUMENTS

CA 3000083 A1 * 10/2018 ..... E04G 21/3242
GB 1048439 A * 11/1966

(Continued)

OTHER PUBLICATIONS

International Search Report and Written Opinion of International Application No. PCT/IB2018/058242 mailed Jul. 10, 2019.

(Continued)

*Primary Examiner* — Jonathan P Masinick
(74) *Attorney, Agent, or Firm* — Ping Wang; Kolas Athena Wang PLLC

(57) ABSTRACT

An anchoring device for a fence, wherein the anchoring device comprises at least one fence post and elongated support beams (1, 2, 3) connected to the fence post to support the fence post, wherein the fence post comprises a post portion (4) comprising a lower section which is provided to extend substantially underground and an upper section which is provided to extend substantially aboveground in installed state of the anchoring device, wherein the anchoring device comprises a first and a second said support beam (1, 2), wherein these support beams (1, 2) are connected to the post portion (4) at the height of the lower section of the post portion (4) in such a way that the first and second support beam (1, 2) extend opposite each other, extend beyond the rear part and are provided to extend substantially underground in installed state of the anchoring device.

14 Claims, 3 Drawing Sheets

(51) Int. Cl.

| | |
|---|---|
| ***E01F 15/06*** | (2006.01) |
| ***E04H 17/00*** | (2006.01) |
| ***E04H 17/20*** | (2006.01) |

(56) References Cited

U.S. PATENT DOCUMENTS

| | | | | |
|---|---|---|---|---|
| 769,479 | A * | 9/1904 | Hutchison | E04H 17/08 52/292 |
| 771,957 | A * | 10/1904 | Weirick | E04H 17/08 256/35 |
| RE22,060 | E * | 4/1942 | Hayden et al. | E01F 15/06 256/13.1 |
| 3,771,273 | A * | 11/1973 | Brodie | F24D 5/04 52/92.1 |
| 4,311,300 | A * | 1/1982 | Buerger | E04H 17/263 256/19 |
| 7,228,661 | B2 * | 6/2007 | Rizzotto | E02D 27/42 52/165 |
| 7,823,348 | B1 * | 11/2010 | Leiva | E02D 27/42 52/297 |
| 7,921,616 | B2 * | 4/2011 | Reyneveld | E02D 27/42 52/297 |
| 8,505,265 | B2 * | 8/2013 | McCollum | E02D 27/42 33/1 G |
| 9,016,656 | B2 * | 4/2015 | Basconi | E04H 12/00 52/153 |
| 10,689,819 | B2 * | 6/2020 | Neusch | E01F 15/0461 |
| 11,613,907 | B2 * | 3/2023 | Fakhari | E04H 17/185 256/25 |
| 2008/0006807 | A1 * | 1/2008 | Coffey | E01F 15/0461 256/24 |
| 2016/0130775 | A1 * | 5/2016 | Brackin | E01F 15/06 256/65.14 |
| 2016/0305152 | A1 * | 10/2016 | Kozyra | E01F 15/0461 |
| 2019/0010727 | A1 * | 1/2019 | Messelis | E01F 15/06 |

FOREIGN PATENT DOCUMENTS

| | | | |
|---|---|---|---|
| GB | 2552498 | | 1/2018 |
| KR | 20110115049 | A * | 10/2011 |
| KR | 101181365 | B1 * | 9/2012 |
| KR | 20150004210 | A * | 1/2015 |
| WO | 2017109808 | | 6/2017 |
| WO | 2017144952 | | 8/2017 |

OTHER PUBLICATIONS

International Preliminary Report on Patentability and Written Opinion of International Application No. PCT/IB2018/058242 mailed Apr. 27, 2021.

* cited by examiner

ANCHORING DEVICE

This application is a national stage application of International Patent Application No. PCT/IB2018/058242, filed Oct. 23, 2018. The entirety of the aforementioned applications is incorporated herein by reference.

FIELD

The present invention relates to an anchoring device for a fence, wherein the anchoring device comprises at least one fence post and elongated support beams connected to the fence post to support the fence post, wherein the fence post comprises a post portion which, in an installed state of the anchoring device, is provided to extend upright, such that the post portion comprises one or several upright extending outer surfaces which form at least a front part, two side parts and a rear part of the post portion and wherein the post portion comprises a lower section which is provided to extend substantially underground and an upper section which is provided to extend substantially aboveground in installed state of the anchoring device. The present invention also relates to a fence comprising at least one such anchoring device.

SUMMARY

The present invention more specifically relates to such an anchoring device and a fence, wherein this fence is a crash barrier. More specifically, but not limiting, fences withstanding crash test M40 P1 according to ASTM F 2656 are envisaged. This crash test is a standard test method for vehicle crash testing of perimeter barriers.

Fences are normally placed on the ground. They often comprise several fence posts to support the fence and to anchor the fence firmly into the ground. To give such a fence a certain rigidity, the fence posts are partially embedded, such that they are partly located under the ground surface, thus underground. They can be embedded in the ground as such and/or a binder such as concrete could be used. It is not uncommon that the bottom of each fence post is at least 1 meter below the ground surface. Therefore to place the fence, relatively deep holes need to be dug in the ground, this certainly with crash barriers. This of course takes time and is also labor-intensive. Another problem that arises is that it is not always possible or easy to dig deep holes. For example, certain surfaces are hard and/or contain many rocks such that a lot of energy is needed to dig holes. In sandy areas holes easily collapse such that holes need to be re-dug several times. This is of course time consuming. Cables such as electricity cables, telephone cables, fiber optic cables and pipelines such as gas pipelines and water pipelines are often present in the underground. When digging holes, it is therefore very important that these cables and/or pipelines are not damaged. However it is often not known where these cables and/or pipelines are situated, such that the need to dig deep holes is problematic.

To solve the abovementioned problem, specific anchoring devices, such as the anchoring device as described in WO2017144952 have been manufactured. This anchoring device has a fence post with connecting elements which are provided to be connected to reinforcement for concrete and support beams connected to the fence post to support the fence. Because this fence post is connected to reinforcement and because of the support beams, it is not necessary that a large part of the fence post is located below the ground surface, to supply enough rigidity to the fence. However for every fence post, part of a support beam is located aboveground to provide enough strength to the fence. This part forms an obstacle and is also not very esthetic. Also it is cumbersome to connect reinforcement to the said connecting elements.

It is therefore an object of the invention to provide an anchoring device for anchoring and supporting a fence, wherein it is not necessary that a large part of the anchoring device is located below the ground surface and wherein this anchoring device does not have the abovementioned problems.

The object of the invention is achieved by an anchoring device for a fence, wherein the anchoring device comprises at least one fence post and elongated support beams connected to the fence post to support the fence post, wherein the fence post comprises a post portion which, in an installed state of the anchoring device, is provided to extend upright, such that the post portion comprises one or several upright extending outer surfaces which form at least a front part, two side parts and a rear part of the post portion, wherein the post portion comprises a lower section which is provided to extend substantially underground and an upper section which is provided to extend substantially aboveground in installed state of the anchoring device, wherein the anchoring device comprises a first and a second said support beam, wherein these support beams are connected to the post portion at the height of the lower section of the post portion and at the height of a said respective side part in such a way that the first and second support beam extend opposite each other, extend beyond the rear part and are provided to extend substantially underground in installed state of the anchoring device.

These anchoring devices are specifically meant for fences that are used as crash barriers or the like which are used to prevent vehicles from crashing through the fence. Such a fence is normally placed so that the front side of the fence is situated on the side where the vehicles must be stopped. The front part of the anchoring device is thus normally also situated on the said side where the vehicles must be stopped. When a vehicle crashes into a fence comprising a said anchoring device, whether or not at the height of a said anchoring device, the vehicle exerts forces on the anchoring device. Because the said support beams extend beyond the rear part, these forces can be well absorbed and directed into the ground. This means that the height of the lower section should not be very high and one does not need to dig big holes to install such an anchoring device. Because of the said support beams, it is possible to firmly anchor a fence into the ground, at relatively shallow depths. For example one can dug a hole that is less than for example 100 cm deep, preferably less than 80 cm deep and preferably between 40 and 60 cm deep, and place the anchoring device in this shallow hole. This means that the lower section than preferably has a height of less than 100 cm, preferably less than 80 cm and preferably between 40 and 60 cm. In an embodiment the said fence post can comprise a base on which the post portion rests, such as a base plate. With the aid of a base, the fence post can easily be placed in a stable manner on the surface of an excavated ditch or hole.

Preferably the lower section of the post portion is provided to be embedded in the ground with the aid of a binder such as concrete. This ensures that the anchoring device is firmly embedded in the ground and can well withstand forces acting upon it.

Preferably the support beams are provided to extend in a substantially horizontal manner. In this way the support beams can be easily provided underground in an installed state.

Preferably the post portion comprises at least a first and a second outer surface which extend opposite to each other, and form the said respective side parts wherein the first and second support beam respectively lie directly or indirectly against the first and the second outer surface. By lying against the said surfaces of the post portion, forces acting upon the post portion, and specifically, forces acting upon the front part of the post portion can be well passed on to the said support bars. In a specific embodiment the first and second outer surface extend substantially parallel to each other and the first and the second support bar extend substantially parallel to each other and parallel to the first and second outer surface. Here one does not have to provide much concrete to embed both these support beams in concrete. The first and the second support bar can however also diverge from each other seen from the front part to the rear part.

Further preferably the post portion has substantially a quadrangular shaped cross-section and comprises said first and said second outer surface, and comprises a third and a fourth outer surface which respectably form the said front part and the rear part of the post portion. Preferably the post portion has substantially a square shaped or a rectangular shaped cross-section.

In a very preferred embodiment the anchoring device comprises a third said support beam, wherein this third support beam is connected to the post portion at the height of the lower section of the post portion and at the height of the front part or the rear part of the post portion, wherein this third support beam forms an angle with the first and the second support beam and wherein the third support beam is provided to extend substantially underground in installed state of the anchoring device. With the aid of said third support beam, which forms an angle with the first and the second support beam, even greater forces acting upon the anchoring device can be absorbed. This because the forces can be passed on into different directions and thus can be better absorbed and directed into the ground. This also means that it is not necessary that a large part of the anchoring device is located below the ground surface, to supply enough rigidity to a fence.

If the post portion comprises the abovementioned first, second and third outer surface, wherein this third outer surface forms the said front or rear part of the side portion, the third support beam than preferably lies directly or indirectly against the third outer surface. Further preferably, if the post portion has the said substantially quadrangular shaped cross-section and comprises said first and said second outer surface, and comprises said third and a fourth outer surface, the third support beam substantially extends according to a second direction and the first and second support beam substantially extend according to a first direction which is perpendicular to the second direction.

Also further preferably, the third support beam is connected to the post portion at the height of the front part of the post portion. With this configuration the anchoring device is very suitable to withstand impact forces which act upon the front of the anchoring device.

Preferably, the first and the second support beam substantially extend in a first direction and the third support beam substantially extends in a second direction which is perpendicular to the first direction. To embed the anchoring device partially underground, one can dig a T-shaped ditch/hole, such that the support beams fit into the ditch/hole.

In a preferred embodiment at least one support beam encloses an interior space that extends according to the longitudinal direction of the said support beam, wherein the said support beam comprises an opening through which this interior space is accessible from the outside. More preferably, each support beam encloses such an interior space and has such an opening. This interior space ensures that the support beam has enough strength, but the weight and the needed material of the support beam is reduced. The opening ensures that the interior space is accessible. The support beams are located underground and are thus embedded. They can be embedded in the ground as such and/or they can be embedded in a binder such as concrete. The opening ensures that the binder (or the ground) can at least partly penetrate into the interior space during the installation of the anchoring device. For example during the embedding of the support beams with concrete, concrete is liquid and can thus easily enter the opening, such that a large part of the interior space can be filled up. This means that with the aid of this support beam, the anchoring device can be very firmly anchored in the ground, this because after the installation of the anchoring device, hardened concrete will be present inside the support beam. Further preferably the said at least one support beam has the shape of a closed profile, such that the support beam comprises the said interior space and two said openings which extend on opposite sides according to the longitudinal direction of the support beam. The interior space is here accessible through two different openings. Such closed profiles can be easily manufactured and have a good strength in comparison with their weight and/or amount of material. Also there are two openings which ensure that the interior space can be well filled up during the embedding of the anchoring device during the installation of the anchoring device. The support beam can for example have a quadrangular shaped cross-section, such as a square shaped cross-section. With such cross-sections the support beam can be easily and be strongly connected to a post portion with a quadrangular shaped cross-section The said opening is also further preferably accessible according to the said longitudinal direction and the third support beam also further preferably extends below the first or the second support beam at the height of the post portion or the third support beam also further preferably extends above the first or the second support beam at the height of the post portion, in such a way that the opening is accessible from the outside. Here the third support beam does not form an obstacle, such that the opening of the first or the second support beam is not (partially) blocked by the third support beam and the opening is easily accessible such that the interior space can be rapidly and smoothly filled up during the embedding of the anchoring device.

Further even more preferably, the first and the second support beam extend approximately at the same height and the third support beam extends below the first and the second support beam. Forces acting upon the front part of the post portion can here be well absorbed.

In a preferred embodiment the said support beams extend substantially perpendicular with regard to the height direction of the post portion. The post portion extends in an upright direction in an installed state of the anchoring device. Preferably the post portion extends substantially vertical. Then the support beams will extend in a substantially horizontal direction. This means that it is easy to embed the support beams and it can be easily assured that the support beams are located substantially underground.

Also forces that act upon the post portion can here be well passed to the support beams such that a fence comprising a said anchoring device can well withstand impact forces.

Preferably a said support beam is connected to the post portion with the aid of two plates which are connected to the post portion and between which the support beam extends. With the aid of plates one can easily attach a said support beam to the post portion. With the aid of plates, a said support beam can be well supported.

Further preferably the post portion and the plates are made out of metal and the plates are welded to the post portion. By welding the plates to the post portion, a said support beam can be strongly connected to the support beam, as such ensuring an anchoring device with sufficient strength.

Further even more preferably, the distance between the plates corresponds to the corresponding measurement of the support beam such that the support beam is virtually clamped between the plates and wherein preferably the support beam is connected to the plates with the aid of connecting elements such as bolts and nuts.

This invention also concerns a fence comprising several anchoring devices for supporting and anchoring the fence, wherein the at least one anchoring device is an anchoring device as described above.

Further preferably this fence comprises several cables which extends at a distance from each other in a substantially horizontal direction, wherein the post portion of the said anchoring device comprises passages through which the cables extend, for holding the said cables. Forces of an impact which are also exerted on the cables, can then easily be transferred from the cables to the said anchoring device such that a strong fence is obtained with a simple construction. These cables can be tensioned (steel) cables.

The fence can be a fence which extends in one direction. The cables than preferably extend in a horizontal direction. This fence can have several anchoring devices according to the invention. The anchoring devices at the ends of the fence can have a different construction. This fence can also have intermediate posts to hold the cables, wherein these posts are not as strongly anchored in the ground as the anchoring device according to the invention. For example if the fence comprises several tensioned cables, these intermediate posts can aid with the support of these cables. Such cables can e.g. be connected to such intermediate posts by means of U-bolts or any other suitable means and can e.g. be connected to the said post portions by means of clamps or any other suitable means.

The object of the invention is also achieved by providing a method of installing an anchoring device as described above. First the anchoring device is placed upon a surface, for example the surface of an excavated ditch or hole. Concrete is provided and poured in such an amount that the lower surface of the post portion is covered and the support beams are covered. If the anchoring device is placed in a ditch or a hole, this ditch or hole is preferably completely filled up with concrete. During the pouring of the concrete one can stimulate the entrance of the concrete into the interior spaces of the support beams, if such interior spaces are present.

The depth of the said excavated hole or ditch is preferably less than 100 cm deep, preferably less than 80 cm deep and preferably between 40 and 60 cm deep.

In a preferred embodiment, a ditch or hole is made for each anchoring device. Here only the ditches/holes need to be filled with concrete and the anchoring devices are firmly anchored in the concrete and thus in the ground. By connecting cables and/or (wire) panels to the said anchoring devices, a fence is formed, wherein the cables and/or (wire) panels are well supported such that the formed fence is very rigid and strong and suitable to be used as a crash barrier.

The present invention is now explained in greater detail below with reference to the following detailed description of some preferred embodiments of an anchoring device according to the present invention. The aim of this description is solely to give illustrative examples and indicate further advantages and particularities and thus cannot be interpreted as a limitation of the field of application of the invention or of the patent rights claimed in the claims.

BRIEF DESCRIPTION OF THE DRAWINGS

In this detailed description, reference is made by means of reference numerals to the appended drawings, wherein.

DETAILED DESCRIPTION

The fence, as partially shown in the figures, comprises several anchoring devices according to the invention, two end anchoring devices (12), one on each end of the fence, and intermediate posts (11).

The fence is a crash barrier which prevents people from entering the area, which lies behind the fence, with a vehicle. The front side of the fence is thus situated on the side where the vehicles must be stopped.

This fence comprises three steel cables (9) which are held under tension at the desired height with the aid of the anchoring devices according to the invention, the end anchoring devices (12) and the intermediate posts (11). The cables (9) extend substantially horizontal and at a distance from each other.

Figure 1:
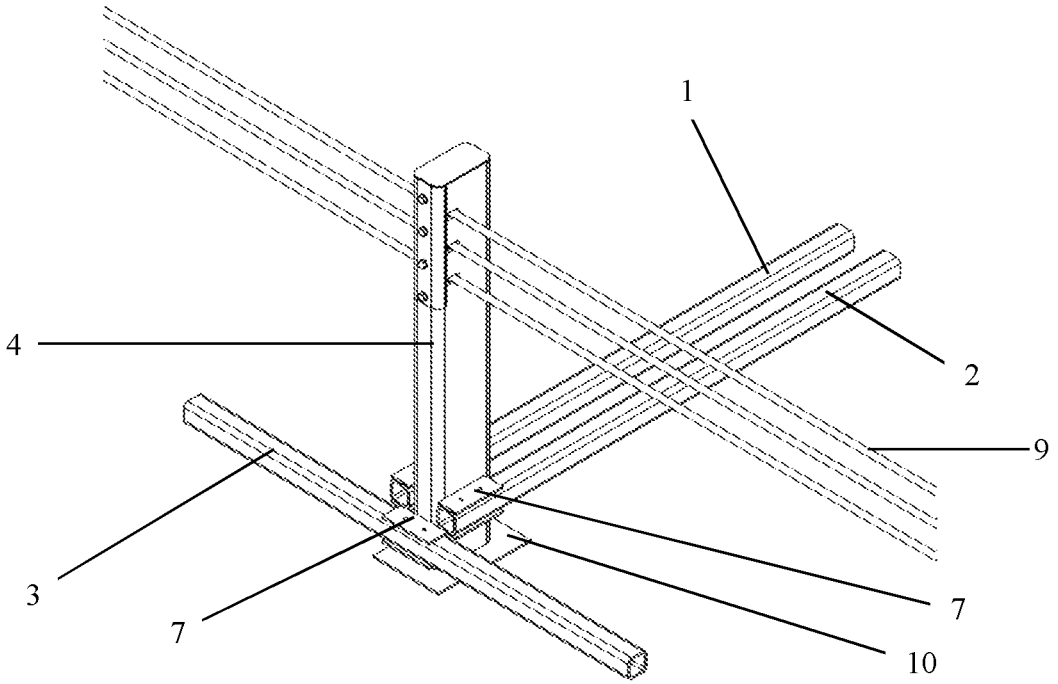
FIG. 1 is a detail of a perspective view of a fence comprising an anchoring device according to the invention.
Figure 2:
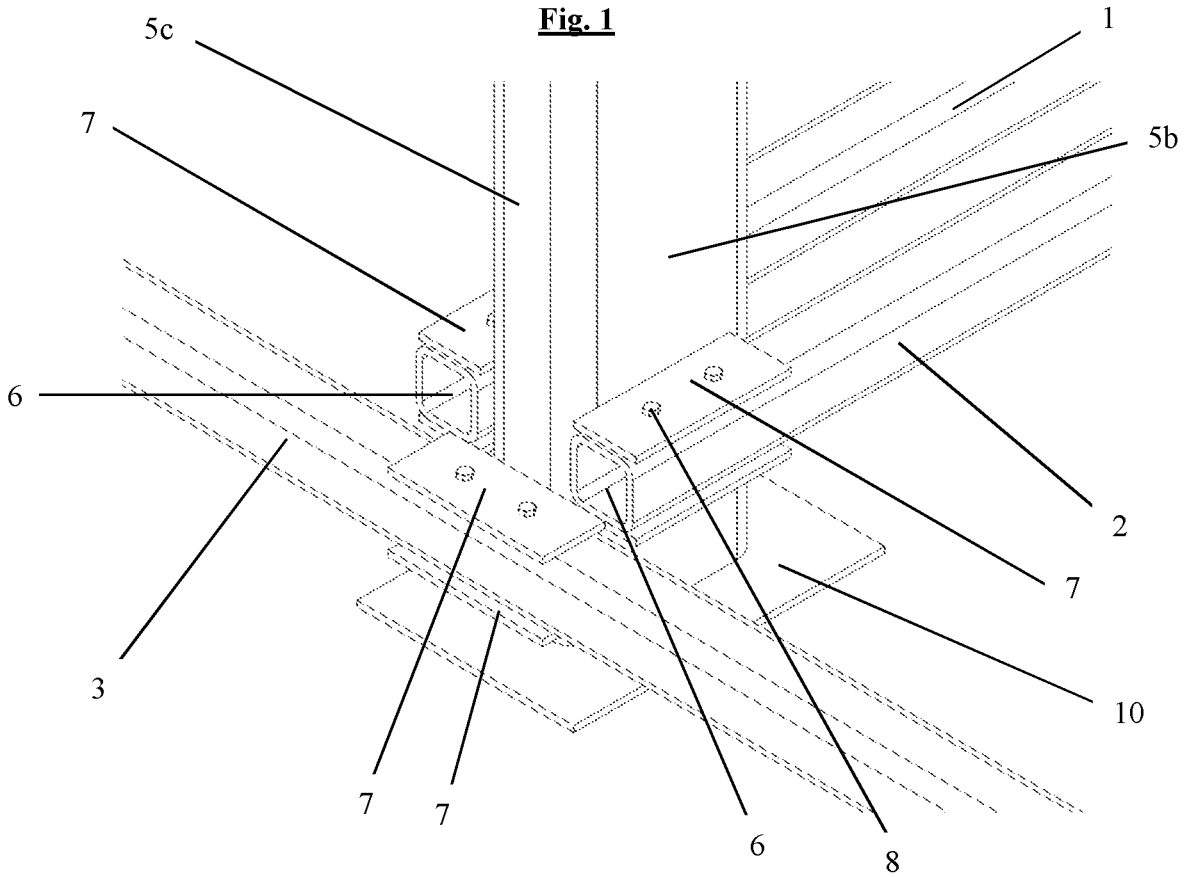
FIG. 2 is a further detail of FIG. 1.
Figure 3:
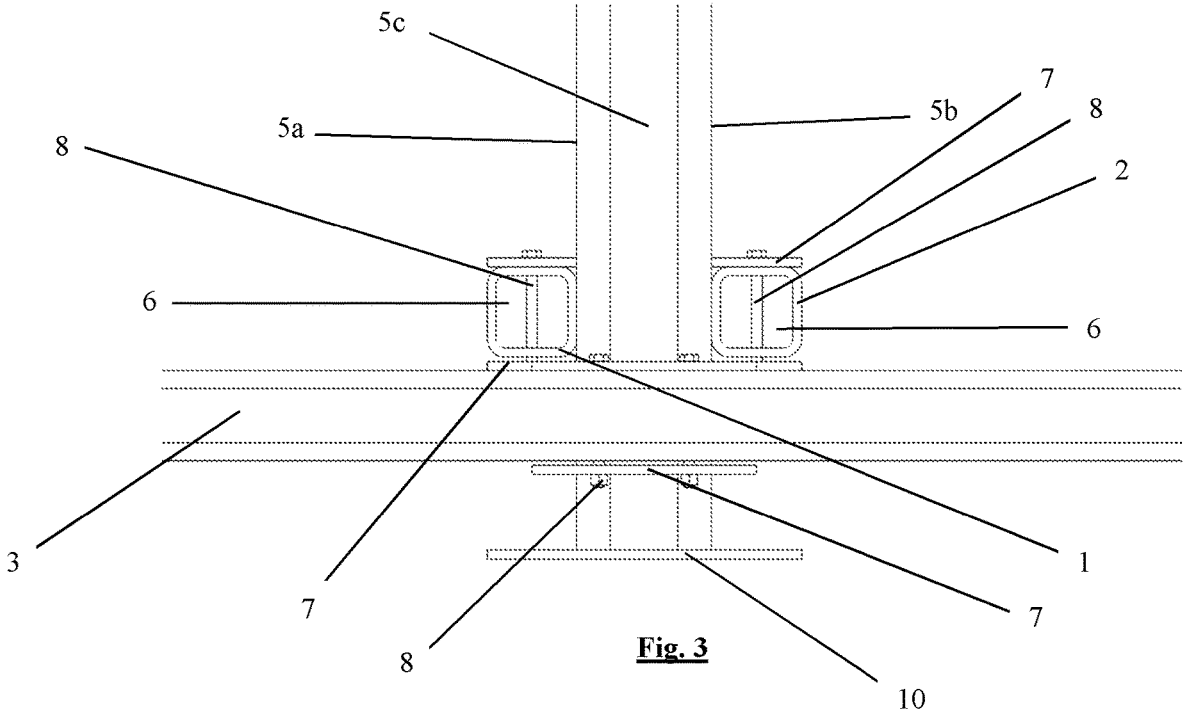
FIG. 3 is a front view of the detail shown in FIG. 2.
Figure 4:
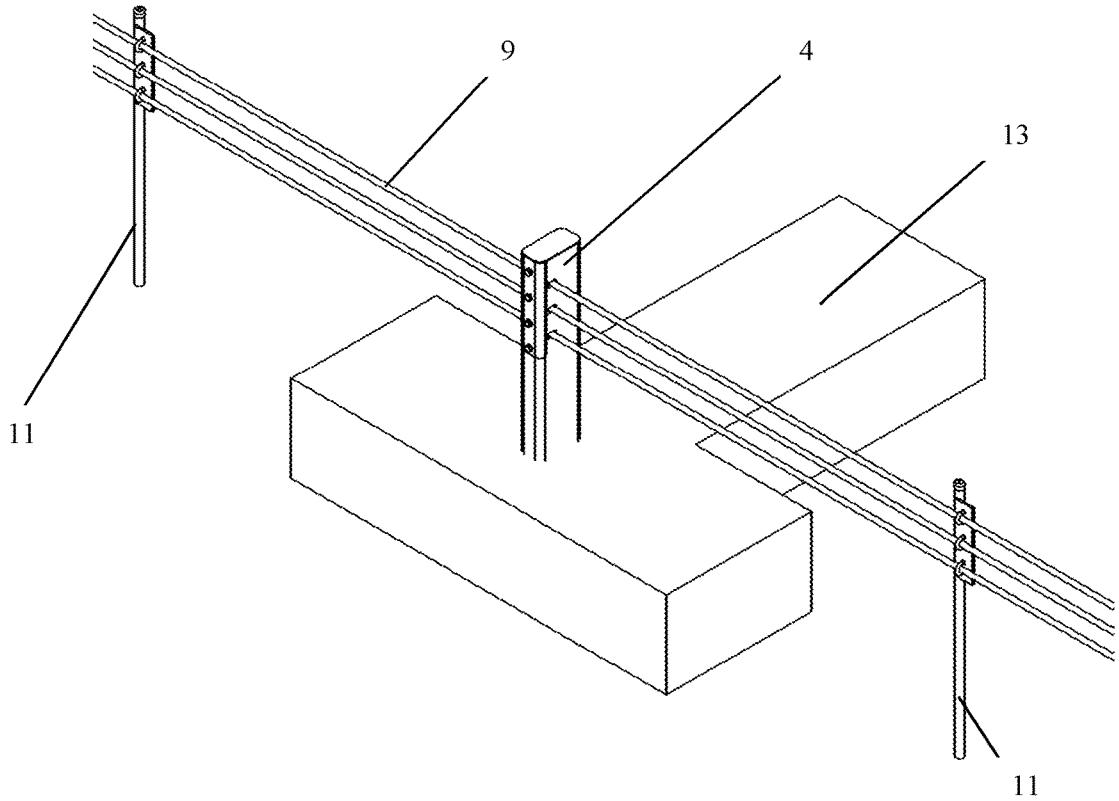
FIG. 4 is a detail of a perspective view of a fence comprising the anchoring device according to the invention, wherein the anchoring device is embedded in concrete.

The fence post according to the invention comprises a fence post and three identical elongated support beams (1, 2, 3) connected to the fence post to support the fence post. Each fence post comprises a post portion (4) and a base plate (10) on which the post portion (4) rests, wherein, in an installed state of the anchoring device, the post portion (4) is provided to extend substantially vertical, such that the post portion (4) comprises one or several upright extending outer surfaces which form at least a front part, two side parts and a rear part of the post portion (4). The base plate (10) rests on the surface upon which the anchoring device is placed and preferably extends substantially horizontal. Each post portion (4) comprises a lower section and an upper section wherein the lower section is provided to extend substantially underground and the upper section is provided to extend substantially aboveground, thus above the ground surface (14), in installed state of the anchoring device. In FIG. 4 the anchoring device is shown when it is embedded in concrete. In FIG. 4 the lower section of the post portion (4) is thus not visible, only the upper section is visible. The amount of concrete used is such that the concrete lies in the plane of the ground surface (14) and thus partially forms the ground surface (14).

The post portion (4) has substantially a rectangular shaped cross section. At the height of the corners, the corners can be rounded or flattened such that the cross section deviates a little of the rectangular shape. This post portion (4) than has a front surface (5*c*), two side surfaces (5*a*, 5*b*) and one rear surface.

A first said support beam (1) is connected to a first said side surface (5*a*) at the height of the lower section and lies directly against this side surface (5*a*), a second said support beam (2) is connected to the second said side surface (5*b*) at the height of the lower section and lies directly against this side surface (5*b*) and the third said support beam (3) is connected to the front surface (5*c*) at the height of the lower section and lies directly against said front surface (5*c*). The support beams (1, 2, 3) are each connected to the post portion (4) with the aid of two metal plates (7) which are welded to the post portion (4) and extend substantially horizontal and at a distance from each other which corresponds with the corresponding measurement of the said support beam (1, 2, 3). The support beams (1, 2, 3) are clamped between the plates (7) and further connected to the plates (7) with the aid of connecting elements (8), here bolts and nuts.

The support beams (1, 2, 3) substantially extend horizontal and the first and the second support beam (1, 2) extend according to a first direction which extends substantially perpendicular to the height direction of the post portion (4) and which extends substantially perpendicular to the front surface (5*c*) of the post portion (4). The third support beam (3) extends according to a second direction which extends substantially perpendicular to the first direction.

The support beams (1, 2, 3) are closed profiles with a square cross section. The support beams (1, 2, 3) thus each have an interior space (6) which is accessible through two openings which extend on opposite sides of the support beam (1, 2, 3). The first and the second support beam (1, 2) are connected to the post portion (4) at the same height and extend on the same height. The third support beam (3) is connected to the post portion (4) at a lower height than the first and the second support beam (1, 2) in such a way that the third support beam (3) completely extends below the first and the second support beam (1, 2). Therefore a said support beam (1, 2, 3) does not block the openings of the other support beams (1, 2, 3).

The upper section of the post portion (4) has three passages through which the cables (9) respectively extend.

The installation of the anchoring device according to the invention can be as follows:

First a ditch is dug out, wherein this ditch has a T-shape. The anchoring device is placed upon the surface of the ditch and this ditch is filled up with concrete. The height of the ditch is such that the support beams (1, 2, 3) are completed embedded in concrete after the ditch is filled up with concrete. In FIG. 4 it can be seen what shape the concrete has and it is clear that the support beams (1, 2, 3) are completely embedded in concrete. During the filling of the ditch with concrete, the interior spaces (6) of the support beams (1, 2, 3) are accessible through their openings such that concrete will flow into the interior spaces (6). During or after the pouring of the concrete, one can actively move the concrete through the openings such that it is ensured that a sufficient amount of the interior spaces (6) is filled with concrete. This provides additional strength to the anchoring device. The part of the anchoring device that is embedded in concrete is located below the ground surface (14) and the other part of the anchoring device, which is not embedded in concrete, is located above the ground surface (14). This means that only the upper section of the post portion (4) is visible after the installation of the anchoring device and thus that the support beams (1, 2, 3) are not visible. A fence comprising said anchoring devices according to the invention is thus esthetical.

Figure 5:
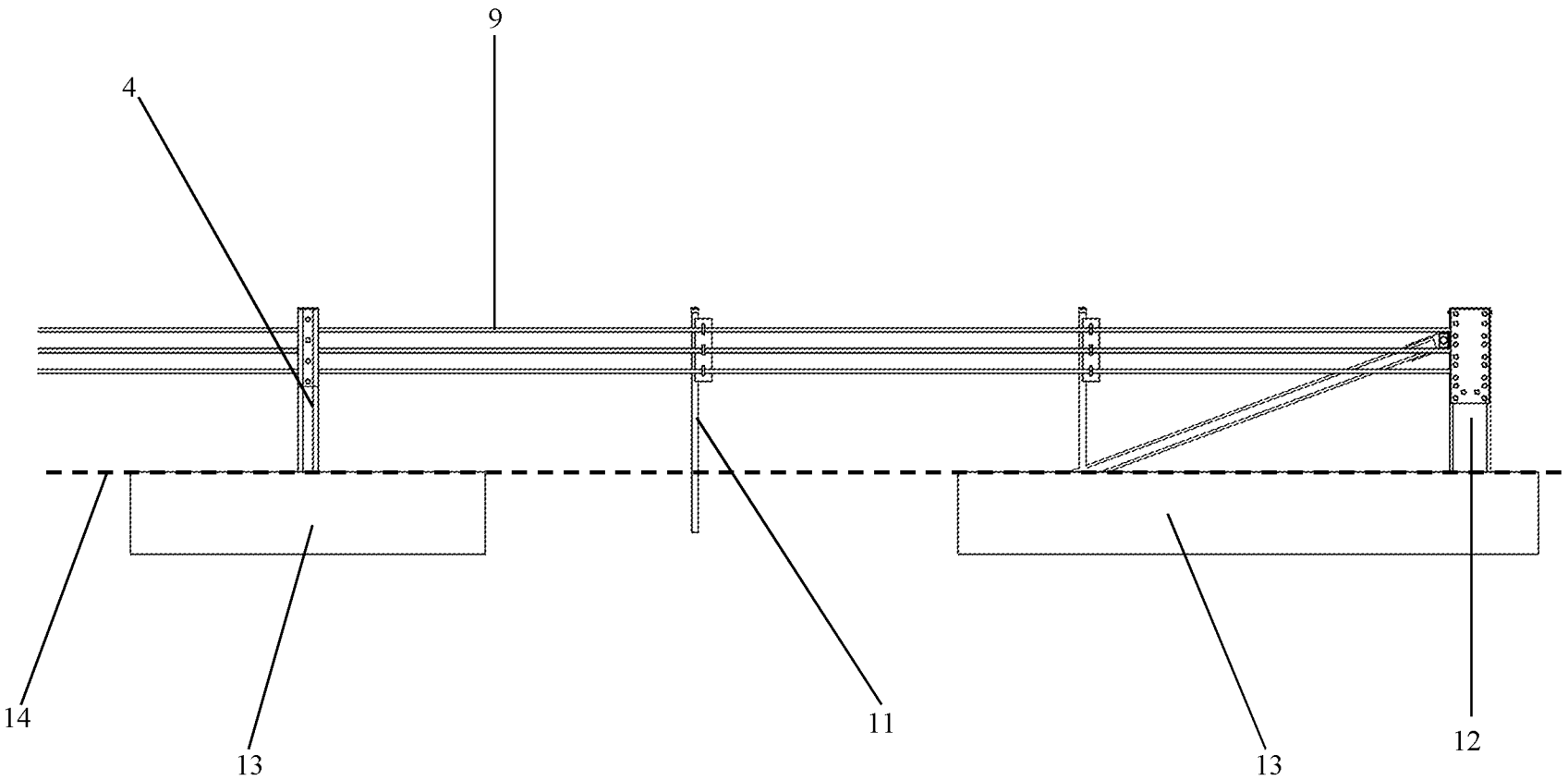
FIG. 5 is a detail of a front view of a fence comprising the anchoring device according to the invention and comprising an end anchoring device, wherein the anchoring devices are embedded in concrete.

Besides the anchoring devices according to the invention, the fence also has end anchoring devices (12) and intermediate posts (11) to hold the cables (9). The end anchoring devices (12), where FIG. 5 shows one end anchoring device (12) which is already embedded in concrete, comprises support beams which extend above the ground surface (14) such that the ends of the fence are very firmly supported. The intermediate posts (11) hold the cables (9) and prevent the cables (9) from bending trough. These intermediate posts (11) should not be embedded in concrete because they do not need to provide strength to the fence.

For this fence one only has to dug out shallow ditches at the height of the anchoring devices. This implies that lesser labor is necessary and lesser concrete is needed to fill up the ditches.

The invention claimed is:

1. An anchoring device for a crash barrier fence which withstands crash test M40 P1 according to ASTM F 2656, wherein the anchoring device comprises at least one fence post and elongated support beams (1, 2, 3) attached to the fence post to support the fence post, wherein the fence post comprises a post portion (4) which, in an installed state of the anchoring device, is provided to extend upright, such that the post portion (4) comprises one or several upright extending outer surfaces which form at least a front part, two side parts and a rear part of the post portion (4), wherein the post portion (4) comprises a lower section which is provided to extend substantially underground and an upper section which is provided to extend substantially aboveground in the installed state of the anchoring device, wherein the anchoring device comprises a first and a second said support beam (1, 2), wherein these support beams (1, 2) are attached to the post portion (4) at the height of the lower section of the post portion (4) and at the height of a said respective side part in such a way that the first and second support beam (1, 2) extend opposite each other, extend beyond the rear part and are provided to extend substantially underground in the installed state of the anchoring device, wherein the first and second support beam lies directly against the first side part of the post and the second support beam lies directly against the second side part of the post, each side part being formed from the outer surfaces of the post that extend opposite to each other, and wherein the post portion (4) is attached to the support beams (1, 2) with the aid of two plates (7) which are connected to the post portion (4) and between which the support beam (1,2) extends.

2. The anchoring device according to claim 1, wherein the post portion (4) has substantially a quadrangular shaped cross-section.

3. The anchoring device according to claim 2, wherein a third support beam (3) is attached to the post portion (4) at a height of the front part of the post portion (4).

4. The anchoring device according to claim 2, wherein the first and the second support beam (1, 2) substantially extend in a first direction and a third support beam (3) substantially extends in a second direction which is perpendicular to the first direction.

5. The anchoring device according to claim 1, wherein at least one support beam (1, 2, 3) encloses an interior space (6) that extends according to the longitudinal direction of the said support beam (1,2, 3), wherein the said support beam (1, 2, 3) comprises an opening through which this interior space (6) is accessible from the outside.

6. The anchoring device according to claim 5, wherein the said at least one support beam (1, 2, 3) has the shape of a closed profile, such that the said support beam (1, 2, 3) comprises the said interior space (6) and two said openings which extend on opposite sides according to the longitudinal direction of the support beam (1, 2, 3).

7. The anchoring device according to claim 5, wherein said opening is accessible according to the said longitudinal direction and that the third support beam (3) extends below the first and/or the second support beam (1, 2) at the height of the post portion (4) or the third support beam (3) extends above the first and/or the second support beam (1, 2) at the height of the post portion (4), in such a way that the opening is accessible from the outside.

8. The anchoring device according to claim 7, wherein the first and the second support beam (1, 2) extend approximately at the same height and in that the third support beam (3) extends below the first and the second support beam (1, 2).

9. The anchoring device according claim 1, wherein said support beams (1, 2, 3) extend substantially perpendicular with regard to the height direction of the post portion (4).

10. The anchoring device according to claim 1, wherein the post portion (4) and the plates (7) are made out of metal and the plates (7) are welded to the post portion (4).

11. The anchoring device according to claim 1, wherein the distance between the plates (7) corresponds to the corresponding measurement of the support beam (1, 2, 3) such that the support beam (1, 2, 3) is virtually clamped between the plates (7) and wherein the support beam (1, 2, 3) is connected to the plates (7) with the aid of connecting elements (8).

12. The anchoring device according to claim 1, wherein the anchoring device comprises a third said support beam (3), wherein this third support beam (3) is connected to the post portion (4) at the height of the of the lower section of the post portion (4) and at the height of the front part or the rear part of the post portion (4), wherein this third support beam (3) forms an angle with the first and the second support beam (1, 2) and wherein the third support beam (3) is provided to extend substantially underground in the installed state of the anchoring device.

13. A crash barrier fence which withstands crash test M40 P1 according to ASTM F 2656 comprising two or more anchoring devices for supporting and anchoring the fence, wherein at least one anchoring device is an anchoring device according to claim 1.

14. The crash barrier fence according to claim 13, wherein the fence comprises several cables (9) which extend at a distance from each other in a substantially horizontal direction, wherein the post portion (4) of the at least one anchoring device comprises passages through which the cables (9) extend, for holding the said cables (9).

* * * * *